US007565932B2

(12) United States Patent
Lawson

(10) Patent No.: US 7,565,932 B2
(45) Date of Patent: Jul. 28, 2009

(54) SUBSEA FLOWLINE JUMPER CONTAINING ESP

(75) Inventor: Peter F Lawson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 135 days.

(21) Appl. No.: 11/697,100

(22) Filed: Apr. 5, 2007

(65) Prior Publication Data

US 2007/0235195 A1 Oct. 11, 2007

Related U.S. Application Data

(60) Provisional application No. 60/789,821, filed on Apr. 6, 2006.

(51) Int. Cl.
*E21B 29/12* (2006.01)
*E21B 43/00* (2006.01)

(52) U.S. Cl. ..... 166/344; 166/339; 166/105; 166/368

(58) Field of Classification Search ..... 166/344, 166/346, 105, 338, 339, 349, 381, 75.51, 166/85.1, 241.3, 105.4
See application file for complete search history.

(56) References Cited

U.S. PATENT DOCUMENTS 3,261,398 A * 7/1966 Haeber ..... 166/352
3,638,732 A * 2/1972 Huntsinger et al. ..... 166/379
4,643,616 A * 2/1987 Castel et al. ..... 405/191
4,848,475 A * 7/1989 Dean et al. ..... 166/357
4,979,880 A * 12/1990 Delaittre ..... 417/406
5,280,766 A * 1/1994 Mohn ..... 166/368
6,059,539 A * 5/2000 Nyilas et al. ..... 417/228
6,068,427 A * 5/2000 Østergaard ..... 405/191
6,292,627 B1 * 9/2001 Gilchrist et al. ..... 392/311
6,412,562 B1 * 7/2002 Shaw ..... 166/335
6,481,504 B1 * 11/2002 Gatherar ..... 166/344
6,760,275 B2 * 7/2004 Carstensen ..... 367/83
6,832,874 B2 * 12/2004 Appleford et al. ..... 405/189
6,880,640 B2 * 4/2005 Barratt et al. ..... 166/346
7,059,345 B2 6/2006 Shaw
7,150,325 B2 12/2006 Ireland et al.
7,219,737 B2 * 5/2007 Kelly et al. ..... 166/339
7,296,629 B2 * 11/2007 Bartlett ..... 166/348
7,314,084 B2 * 1/2008 Rodrigues et al. ..... 166/344
7,422,066 B2 * 9/2008 Rodrigues et al. ..... 166/341
7,481,270 B2 * 1/2009 Shepler ..... 166/105
2003/0217848 A1 11/2003 Shaw
2004/0134662 A1 * 7/2004 Chitwood et al. ..... 166/367
2004/0226722 A1 11/2004 Colyer et al.

(Continued)

FOREIGN PATENT DOCUMENTS

GB 2360302 9/2001

*Primary Examiner*—Thomas A Beach
(74) *Attorney, Agent, or Firm*—Bracewell & Giuliani LLP

(57) ABSTRACT

A subsea production system on a sea floor has a pump flowline jumper with a straight intermediate portion and two end portions. Each end portion has a connector for ROV assisted connection between production units. A submersible pump assembly is mounted in the straight portion of the flowline jumper and is lowered along with the flowline jumper into engagement with the production receptacles. The pump assembly boosts pressure of fluid flowing from one of the receptacles to the other. A gas separator may be mounted in the same flowline jumper or in a separate flowline jumper.

14 Claims, 2 Drawing Sheets

U.S. PATENT DOCUMENTS

2005/0016735 A1 1/2005 Ireland et al.
2005/0173322 A1* 8/2005 Ostergaard ..... 210/170
2005/0238440 A1 10/2005 Jordan et al.
2006/0231266 A1* 10/2006 Rodrigues et al. ..... 166/365
2007/0029008 A1* 2/2007 Liu ..... 141/387

* cited by examiner

SUBSEA FLOWLINE JUMPER CONTAINING ESP

CROSS-REFERENCE TO RELATED INVENTION

This application claims priority to provisional patent application 60/789,821, filed Apr. 6, 2006.

FIELD OF THE INVENTION

This invention relates in general to subsea well production systems, and in particular to flowline jumpers connecting multiple subsea production trees with a manifold.

BACKGROUND OF THE INVENTION

Offshore hydrocarbon production wells may be located in water thousands of feet deep. Some wells have inadequate internal pressure to cause the well fluid to flow to the sea floor and from the sea floor to a floating production vessel at the surface. Though not extensively used yet, various proposals exist to install booster pumps at the sea floor to boost the pressure of the well fluid.

U.S. Pat. No. 7,150,325 discloses installing a submersible rotary pump assembly in a caisson at the sea floor. The caisson has an inlet connected to a production unit, such as a subsea production tree, and an outlet leading to a second production unit, such as a manifold. The pump assembly is located within a capsule in the caisson in a manner that allows the capsule, with the pump therein, to be installed and retrieved from the caisson with a lift line. That solution has its merits, but does require constructing a caisson or using an abandoned well.

Flowline jumpers are commonly employed to connect various sea floor production units to each other. A flowline jumper is a pipe having connectors on its ends for connection to inlets and outlets of the production units. It is known to install a flowline jumper by lowering it from a vessel on a lift line and using a remote operated vehicle (ROV) to make up the connections. Flowline jumpers may have U-shaped expansion joints with the connectors on downward extending legs for stabbing into receptacles of the production units. Generally, a flowline jumper is simply a communication pipe and contains no additional features for enhancing production.

SUMMARY OF THE INVENTION

The subsea production system of this invention includes a pump flowline jumper having connectors at upstream and downstream ends for connection between first and second production receptacles on the sea floor. One receptacle may be on one subsea structure, such as on a tree assembly, and the other on another subsea structure, such as a manifold. Alternately, the receptacles may be located on the same subsea structure, such as on a base positioned between two subsea structures. A submersible pump assembly is mounted within the pump flowline jumper prior to installing the flowline jumper. The pump flowline jumper with the pump assembly contained therein is lowered on a lift line and connected to the first and second receptacles.

Optionally, the portion of the pump flowline jumper containing the pump assembly is inclined with the upstream end at a lower elevation than the downstream end. Optionally a gas separator may be installed within the pump flowline jumper upstream of the pump assembly for separating gas prior to entry into the pump assembly. In the preferred embodiment, the pump assembly comprises an electrical motor that drives a rotary pump, such as a centrifugal or progressing cavity pump. Preferably the motor is located upstream from the pump so that the well fluid flowing into the flowline jumper flows over the motor before entering the pump.

In the preferred embodiment the pump flowline jumper has a substantially straight intermediate section in which the pump assembly is located. An inverted generally U-shaped section is located on each end of the intermediate section, having an upward extending leg and a downward extending leg. Connectors of the flowline jumper are located on the downward extending legs.

DETAILED DESCRIPTION OF THE INVENTION

Figure 1:
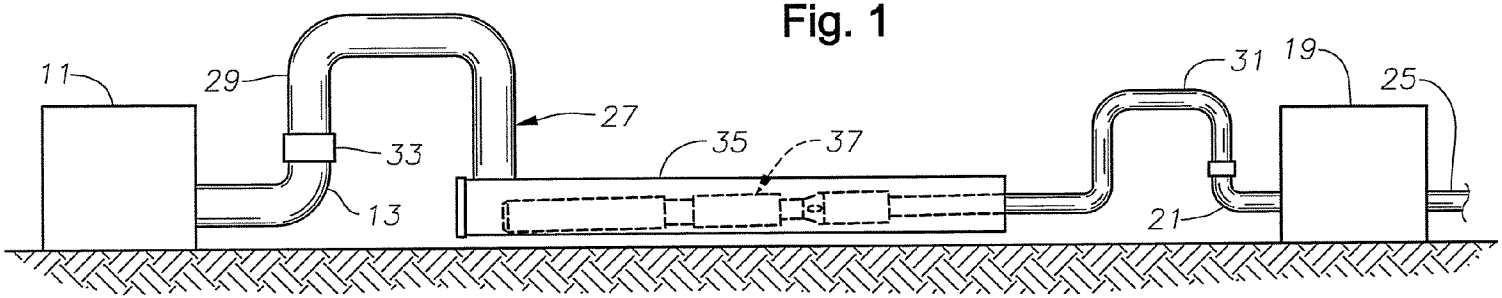
FIG. 1 is a schematic side view illustrating part of a subsea production system in accordance with this invention.

Referring to FIG. 1, a subsea production tree 11 is schematically illustrated. Tree 11 is a production unit located at the upper end of a well and has pressure control equipment for controlling the well fluid flow from the well. The pressure control equipment includes a number of valves, typically hydraulically actuated. Normally, tree 11 will contain other equipment such as an adjustable choke for controlling the back pressure of the flowing well fluid. Tree 11 has a production flow receptacle or outlet 13 with an upward facing end in this example. Tree 11 is located on a sea floor and is remotely controlled.

Figure 2:
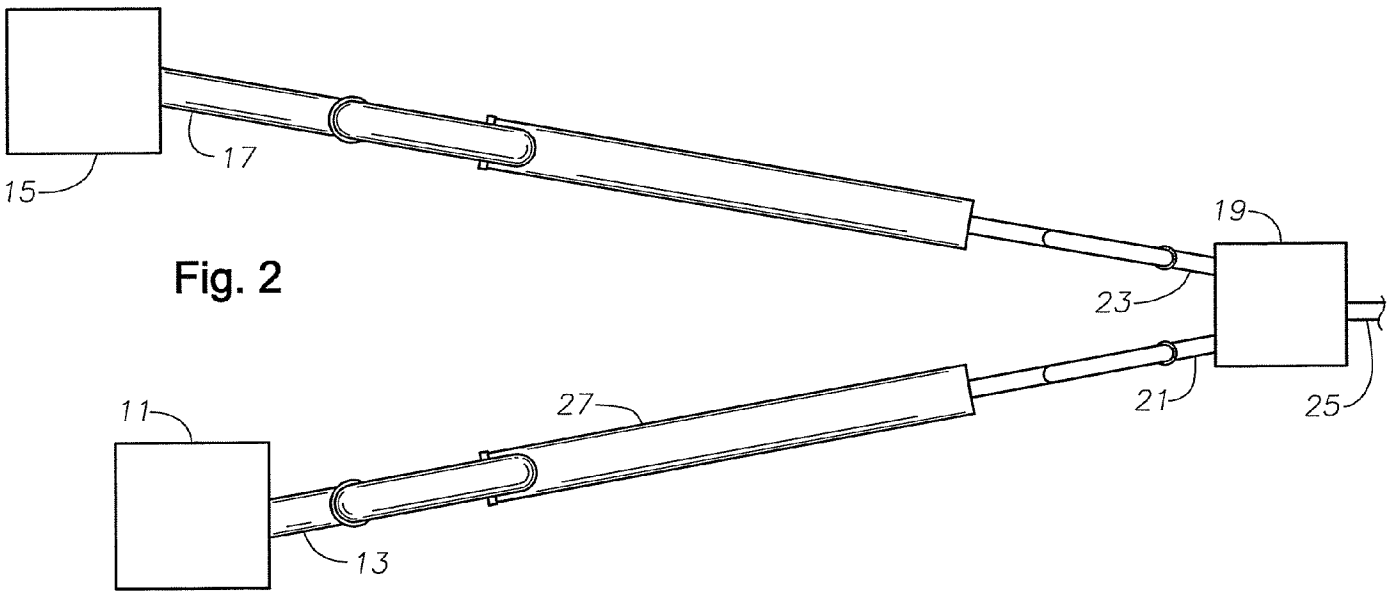
FIG. 2 is a plan view of the system of FIG. 1.

As shown in FIG. 2, another tree 15, which may be identical to tree 11, is located on the sea floor some distance from tree 11 at the upper end of another well. Tree 15 has a flow outlet or receptacle 17 with an end that faces upward in this example. Trees 11 and 15 deliver well fluid to a production unit such as manifold 19, located some distance from trees 11 and 15. Manifold 19 has separate upward-facing receptacles or inlets 21, 23 for receiving fluid flow from each tree 11, 15. Outlets 13, 17 and inlets 21, 23 could alternately face horizontally, rather than upward. Manifold 19, which typically gathers fluid from other subsea trees (not shown), commingles the flow and discharges the flow out a single outlet 25. Outlet 25 leads to well fluid processing equipment, which may be a floating production vessel or subsea processing equipment.

A flowline jumper 27 connects tree 11 to manifold 19, and a similar flowline jumper 27 connects tree 15 to manifold 19. Flowline jumpers 27 have lengths sized for the spacing between trees 11, 15 and manifold 19. Each flowline jumper 27 has an upstream end 29 and a downstream end 31. Both ends 29, 31 comprise legs that face downward in this example. Also, a connector 33 is connected to each end 29, 31 for engagement with one of the outlets 13, 17 or inlets 21, 23. Preferably, each connector 37 is hydraulically actuated, which may be with the assistance of a remote operated vehicle (ROV).

In this example, flowline jumper 27 has a straight generally horizontal section 35 connected between two "U-shaped" expansion joints or sections, defining an overall "M" shape. Alternately, the U-shaped sections on the ends could be eliminated, providing a general downward facing U-shaped configuration for the entire flowline jumper 27 rather than an "M-shaped" configuration.

Each flowline jumper 27 contains an electrical submersible pump (ESP) 37 within straight section 35. ESP 37 boosts the pressure of the fluid flowing into flowline jumper 27 from tree 11 and delivers the fluid to manifold 19. A similar ESP 37 boosts the pressure of the fluid flowing into the flowline jumper 27 connecting tree 15 with manifold 19.

Figure 3A:
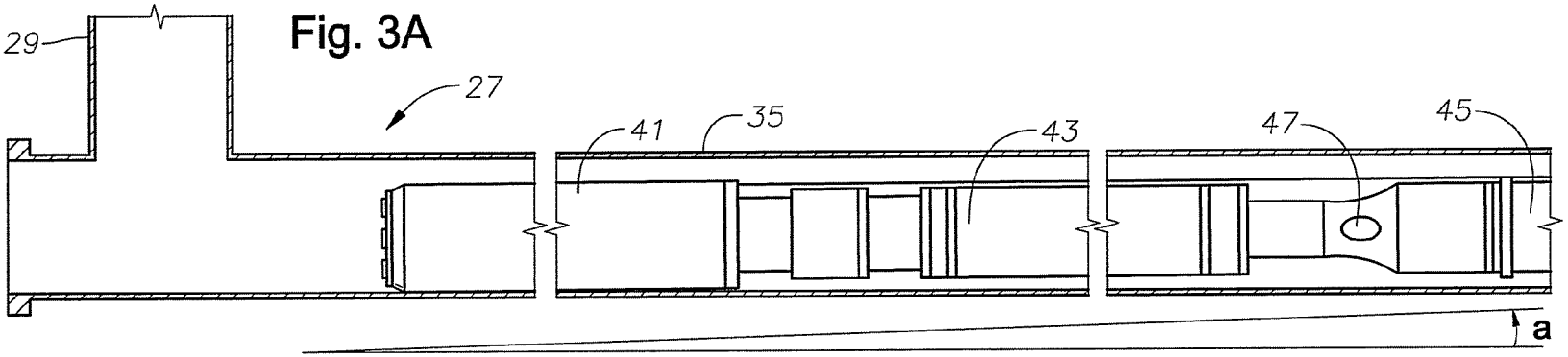
FIGS. 3A and 3B comprise a partially schematic enlarged view of a portion of the flowline jumper shown in FIGS. 1 and 2 and also illustrating an electrical submersible pump assembly contained therein.
Figure 3B:
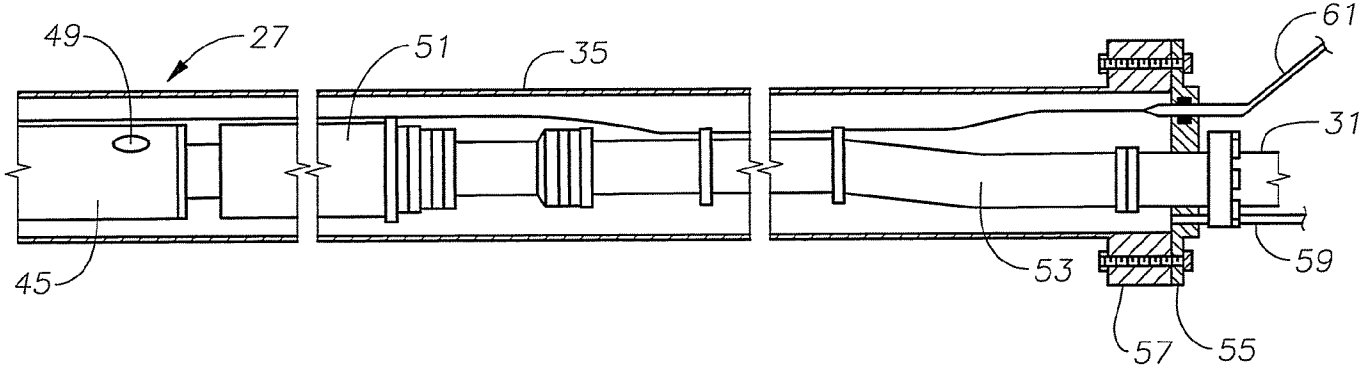

Referring to FIG. 3A, each ESP 37 includes an electrical motor 41 that is typically a three-phase AC motor. Motor 41 is filled with a dielectric fluid for lubricating and cooling. A seal section 43 is connected to motor 41 for sealing the lubricant within motor 41 and equalizing the pressure difference between the lubricant and the well fluid pressure in the interior of jumper 27. An optional gas separator 45 is connected to seal section 43 and has an intake 47 for receiving well fluid flowing into flowline jumper 27. Gas separator 45 may be employed if the well produces a sufficient quantity of gas along with the liquid so as to impede the efficiency of ESP 37. Gas separator 45 preferably has a rotary or vortex separator within it that separates liquid from gas and discharges the gas out an outlet 49 into conduits in the interior of flowline jumper 27.

Gas separator 45 is connected to a centrifugal pump 51. Centrifugal pump 51 contains a large number of stages, each stage containing an impeller and a diffuser. Motor 41 rotates the impellers to cause fluid to flow from gas separator 45 or the pump intake into pump 51 and out through a discharge tube 53. The discharge pressure is isolated from the intake pressure. In this embodiment, the isolation is handled by a discharge tube 53 that extends sealingly into a flange or cap 55. Flange 55 bolts to a collar 57 that is secured to the end of flowline jumper straight section 35. The downstream end 31 of flowline jumper 27 bolts to flange 55 in this embodiment. Other devices to isolate discharge pressure from intake pressure could be used.

A gas outlet 59 extends through flange 55 for the removal of separated gas from flowline jumper 27. Gas outlet 59 optionally may lead to manifold 19 (FIG. 1) where it may be delivered for further processing or re-injection back into one of the wells.

In this embodiment, a power cable 61 has a penetrator that extends sealingly through flange 55 to motor 41. Power cable 61 will be connected to a source of power, preferably subsea, such as in a wet mate connector system located at manifold 19 or other subsea equipment. When running or retrieving flowline jumper 27, an ROV may be used to connect and disconnect the wet mate connector on manifold 19. If multiple flowline jumpers 27 and ESP's 37 are employed, manifold 19 or other subsea equipment could have a power distribution system.

Preferably, the penetration of power cable 61 through flange 55 is a dry penetration system that is installed and disconnected while flowline jumper 27 is on the platform, not subsea. Optionally, straight section 35 of flowline jumper 27 is inclined a few degrees relative to horizontal, as indicated by the angle a in FIG. 3A. The lower end of straight section 35 will be the upstream end.

In operation, ESP 37 will be installed within flowline jumper 27 on a vessel or at a dock-side. The entire assembly is then lowered into the sea with a lift line or cable and a spreader bar. With the assistance of an ROV, ends 29, 31 of flowline jumper 27 will land on outlet 13 of tree 11 and on manifold inlet 21. Hydraulic connectors 33 are actuated to complete the connections. The same procedure is followed to connect the other flowline jumper 27 between tree 15 and manifold inlet 23.

When trees 11, 15 are producing, the well fluid will flow into flowline jumpers 27. The ESP 37 in each flowline jumper 27 boosts the pressure and discharges the fluid into manifold 19. If gas separator 45 (FIG. 2A) is employed, it will separate gas prior to the entry of well fluid into pump 51. The separate ESP's 37 in each flowline jumper 27 can be sized to provide different pressure boosts from each other to optimize production from the separate trees 11, 15. Also, the speeds of the separate ESP's can be individually controlled to match the production from each tree 11, 15.

For maintenance or repair, the entire flowline jumper 27 will be released from outlet 13 and inlet 21 and the assembly brought to the surface with a lift line. The ESP 37 contained therein can be readily withdrawn on the vessel at the surface and serviced or replaced.

The invention has significant advantages. The pump assembly can be retrieved for repair or replacement by using a lift line and an ROV to retrieve the entire jumper. A gas separator can be mounted either in the same or a separate flowline jumper. Pumps can be mounted in parallel flowline jumpers so as to be independently retrievable.

While the invention has been shown in only one of its forms, it should be apparent to those skilled in the art that it is not so limited but is susceptible to various changes without departing from the scope of the invention.

I claim:

1. A subsea pumping apparatus for pumping fluid from a first to a second receptacle of a subsea production system on a sea floor, the apparatus comprising:

a pump flowline jumper having connectors at upstream and downstream ends for connection between the first and second receptacles comprising;

a submersible pump assembly having a longitudinal axis and mounted within the pump flowline jumper, the pump assembly having an intake for receiving fluid flowing from the first receptacle and a discharge for flowing the fluid to the second receptacle;

the flowline jumper extending from the pump assembly discharge in a direction coaxial with the axis of the pump assembly; and wherein the pump flowline jumper with the pump assembly contained therein is retrievable from the first and second receptacles.

2. The apparatus according to claim 1, wherein the portion of the pump flowline jumper containing the pump assembly is inclined with the upstream end at a lower elevation than the downstream end.

3. The apparatus according to claim 1, wherein the pump assembly further comprises:

a gas separator within the pump flowline jumper upstream of the pump assembly for separating gas prior to entry into the pump assembly, the gas separator discharging separated gas into the interior of the pump flowline jumper; and a gas outlet extending from the pump flowline jumper.

4. The apparatus according to claim 1, wherein at least one of the connectors has a U-shape.

5. The apparatus according to claim 1, wherein the pump assembly comprises an electrical motor and a centrifugal pump.

6. The apparatus according to claim 5, wherein the motor is located upstream from the pump so that the well fluid flowing into the flowline jumper flows over the motor before entering the pump.

7. The apparatus according to claim 1, wherein the flowline jumper extends from the intake in a direction transverse to the axis of the pump assembly.

8. The apparatus according to claim 1, wherein the axis of the pump assembly and the axis of the flowline jumpers are in the same plane.

9. A subsea pumping apparatus for pumping fluid from a first to a second receptacle of a subsea production system on a sea floor, the apparatus comprising:

a pump flowline jumper having connectors at upstream and downstream ends for connection between the first and second receptacles;

a submersible pump assembly mounted within the pump flowline jumper, the pump assembly having an intake for receiving fluid flowing from the first receptacle and a discharge for flowing the fluid to the second receptacle;

wherein the pump flowline jumper with the pump assembly contained therein is retrievable from the first and second receptacles;

wherein the pump flow line jumper comprises:

a substantially straight intermediate section in which the pump assembly is located;

an inverted generally U-shaped section on each end of the intermediate section, having an upward extending leg and a downward extending leg; and the connectors at the upstream and downstream ends of the flowline jumper are located on the downward extending legs.

10. A subsea pumping apparatus for pumping fluid from a first to a second receptacle of a subsea production system on a sea floor, the apparatus comprising:

a pump flowline jumper having a substantially straight intermediate portion and two end portions, each end portion having a connector for connection between the first and second receptacles;

a submersible pump assembly having an electrical motor coupled to a rotary pump, the motor and pump being mounted within an intermediate portion of the pump flowline jumper, defining an annulus for fluid flow from the first receptacle over the motor to an intake of the pump, the pump having a discharge separated from the intake by a pressure barrier and leading to the second receptacle; and wherein the connectors for the pump flowline jumper are remotely operable to enable the pump flowline jumper along with pump assembly contained therein to be installed and retrieved on a lift line.

11. The apparatus according to claim 10, wherein the intermediate portion of the pump flowline jumper is inclined so as to elevate the discharge of the pump above the intake of the pump.

12. The apparatus according to claim 10, wherein each of the end portions of the pump flowline jumper comprises:

an inverted generally U-shaped section, having an upward extending leg and a downward extending leg; and the connectors are located on the downward extending legs.

13. A method of pumping fluid from a first receptacle to a second receptacle located on a sea floor of a subsea production system, comprising:

(a) mounting a submersible pump assembly within a pump flowline jumper;

(b) mounting a gas separator within the pump flowline jumper upstream of the pump assembly; then (c) lowering the pump flowline jumper on a line into engagement with the first and second receptacles, and connecting ends of the pump flowline jumper to the first and second receptacles; then (d) operating the pump assembly and flowing fluid from the first receptacle through the pump assembly to the second receptacle; and (e) separating gas with the gas separator prior to entry into the pump assembly, discharging the separated gas into the interior of the pump flowline jumper, and flowing the discharged gas from the interior to the exterior of the pump flowline jumper.

14. The method according to claim 13, wherein step (b) comprises:

inclining the portion of the pump flow line jumper containing the pump assembly so that when connected to the first and second receptacles, an intake of the pump assembly will be at a lower elevation than a discharge of the pump assembly.

* * * * *